US012492454B2

(12) United States Patent
Watanabe et al.

(10) Patent No.: US 12,492,454 B2
(45) Date of Patent: Dec. 9, 2025

(54) HIGHLY CORROSION-RESISTANT Ni-Cr-Mo-N ALLOY HAVING SUPERIOR PHASE STABILITY

(71) Applicant: Nippon Yakin Kogyo Co., Ltd., Tokyo (JP)

(72) Inventors: Takayuki Watanabe, Kawasaki (JP); Shigeru Hirata, Kawasaki (JP)

(73) Assignee: NIPPON YAKIN KOGYO CO., LTD., Tokyo (JP)

( * ) Notice: Subject to any disclaimer, the term of this patent is extended or adjusted under 35 U.S.C. 154(b) by 408 days.

(21) Appl. No.: 18/015,854

(22) PCT Filed: Jul. 27, 2021

(86) PCT No.: PCT/JP2021/027799
§ 371 (c)(1),
(2) Date: Jan. 12, 2023

(87) PCT Pub. No.: WO2022/025083
PCT Pub. Date: Feb. 3, 2022

(65) Prior Publication Data

US 2023/0250518 A1 Aug. 10, 2023

(30) Foreign Application Priority Data

Jul. 31, 2020 (JP) ..... 2020-130437

(51) Int. Cl.
*C22C 30/02* (2006.01)

(52) U.S. Cl.
CPC ..... *C22C 30/02* (2013.01)

(58) Field of Classification Search
CPC ..... C22C 19/055; C22C 19/053; C22C 30/02; C22C 38/001; C22C 38/004; C22C 38/02; C22C 38/04; C22C 38/06; C22C 38/42; C22C 38/44; C22C 38/54; C22F 1/10
See application file for complete search history.

(56) References Cited

U.S. PATENT DOCUMENTS 4,742,324 A * 5/1988 Shida ..... C22C 38/46 219/544
5,858,129 A 1/1999 Kobayashi et al.

FOREIGN PATENT DOCUMENTS

| | | | |
|---|---|---|---|
| JP | H10-060603 | A | 3/1998 |
| JP | 2002-322545 | A | 11/2002 |
| JP | 3512304 | B2 | 3/2004 |
| JP | 2010-031313 | A | 2/2010 |
| JP | 2018-031028 | A | 3/2018 |
| JP | 2018-037248 | A | 3/2018 |
| JP | 2018-172709 | A | 11/2018 |
| JP | 2020-033579 | A | 3/2020 |
| WO | 2016/076254 | A1 | 5/2016 |

OTHER PUBLICATIONS

Feb. 9, 2023 International Preliminary Report on Patentability issued in International Application No. PCT/JP2021/027799.
Oct. 19, 2021 Search Report issued in International Application No. PCT/JP2021/027799.

* cited by examiner

*Primary Examiner* — Jessee R Roe
(74) *Attorney, Agent, or Firm* — Oliff PLC

(57) ABSTRACT

A highly corrosion-resistant Ni—Cr Mo—N alloy including in weight %, Ni: 22.0% or more, Cr: 22.0% or more, Mo: 5.0% or more, N: 0.180% or more, Si, Al, Mn, Fe as a remainder, and inevitable impurities, wherein the composition satisfies the following Formulas (1) to (3), and an area ratio of a sigma phase in a cross-sectional structure measured by EBSD after holding at 950° C. for 30 minutes is 1.0% or less $$Cr+3.3\times Mo+16\times N\geq 43.0 \quad (1)$$

$$7.3\times Mo—Ni\leq 21.0 \quad (2\text{-}1)$$

$$1.3\times Cr—Ni\leq 5.7 \quad (2\text{-}2)$$

$$1.6\times Si+0.99\times Mn+2.2\times Al\leq 0.95 \quad (3).$$

4 Claims, 4 Drawing Sheets

HIGHLY CORROSION-RESISTANT Ni-Cr-Mo-N ALLOY HAVING SUPERIOR PHASE STABILITY

TECHNICAL FIELD

The present invention relates to Ni—Cr—Mo—N alloys having superior corrosion resistance, even if heat treatment is performed when the process of heating to a high temperature is essential in the production process for products such as sheathed heaters produced by brazing, heat exchangers, automotive exhaust system parts, and the like, or parts that need to be subjected to post-welding heat treatment (hereinafter abbreviated as PWHT) after welding.

BACKGROUND ART

Since alloys containing large amounts of Cr, Mo, and N are superior in corrosion resistance, they are used in severely corrosive environments, and brazing is often used in the production process. In this case, to melt and permeate the brazing material, it is heated to a temperature of 900° C. or higher and held for a certain period of time. If an alloy containing a large amount of Cr and Mo is held at such a temperature, a sigma phase may be precipitated, resulting in decrease in corrosion resistance, which may pose a problem. Therefore, the treatment is performed at a temperature higher than that at which the sigma phase is not precipitated, for example, at a temperature 1150° C. However, if brazing is performed at such a temperature, deformation due to heating may occur during high temperature holding, deformation due to cooling, or new residual strain may occur. Therefore, there is a need for alloys that can be brazed at lower temperatures, that is, alloys in which it is difficult to precipitate the sigma phase and in which it is possible to minimize the amount of precipitation.

Alternatively, alloys related to the present invention are often joined and assembled by welding. The residual strain generated by welding causes deformation and cracking over time due to stress corrosion cracking, and it is generally removed, and heat treatment called PWHT is performed. For stress relief, heat treatment is often performed at about 600 to 900° C. However, in alloys containing a large amount of Cr and Mo, if held at these temperatures, precipitation of Cr carbides and precipitation of the sigma phase will reduce corrosion resistance. Therefore, it is performed at higher temperatures, for example, 1150° C. or more. The problems here are the same as in the case of brazing, and there is a need for alloys in which the sigma phase is difficult to precipitate even if PWHT is performed, and the amount of precipitation can be minimized.

As prior art related to the control of the precipitation of the sigma phase, for example, in Patent Document 1, steel containing Cu, La, and Ce is controlled by specifying the hot rolling conditions such as the heating temperature, the holding time, and the number of heating, and a steel with a sigma phase content of 1% by volume or less and a production method are proposed. The purpose is to improve elongation and bendability in the direction perpendicular to the rolling direction, and the amount of sigma phase is measured by observing the C section based on JIS G 0555. Although Patent Document 1 focuses on controlling the sigma phase, it does not consider its effect on corrosion resistance.

In Patent Document 2, regarding steels containing Cu, a relational formula of constituent elements for controlling the sigma phase amount in the central part of the plate thickness to be less than 1% in terms of area ratio, a relational formula for controlling the occurrence of corrosion, and a relational formula for controlling its progress are proposed, and by combining these relational formulas, steels in which the sigma phase is controlled and having superior corrosion resistance are proposed. The subject matter is the steels that were subjected to solution heat treatment, but sigma phase precipitation and corrosion resistance in materials that were subjected to brazing and PWHT, were not considered.

In Patent Document 3, also regarding steels containing Cu, by controlling the component with a relational formula composed of Fe, Cr, Mo, Ni, and Cu, steels in which the sigma phase area is 1% or less in the range from the surface layer to a depth of 0.1 μm are proposed. The purpose is to ensure corrosion resistance after brazing, but since the use environment is assumed to be a special environment containing sulfuric acid and hydrochloric acid, corrosion resistance may not be sufficient in environments that mainly contain chlorides. One of the points for controlling the sigma phase is addition of Cu, but it is a very expensive element, and improvement in corrosion resistance in environments containing chloride is not worth the cost. Although the brazing is performed at 1150° C., it is desirable to be able to perform the brazing at a lower temperature to reduce deformation and residual strain.

Patent Document 4 proposes an austenitic stainless steel in which crevice corrosion resistance and hot workability are improved by suppressing precipitation of the sigma phase in a steel ingot. However, since the object is a steel ingot and the purpose is to suppress the generation of the sigma phase in the solidified structure, and the object is a plate obtained by hot working, the brazing process is not considered.

The Patent documents are as follows.

Patent document 1: Japanese Unexamined Patent Application Publication No. 2002-322545

Patent document 2: WO2016/076254

Patent document 3: Japanese Unexamined Patent Application Publication No. 2018-172709

Patent document 4: Japanese Patent No. 3512304

SUMMARY OF INVENTION

Problems Solved by the Invention

Figure 1A:
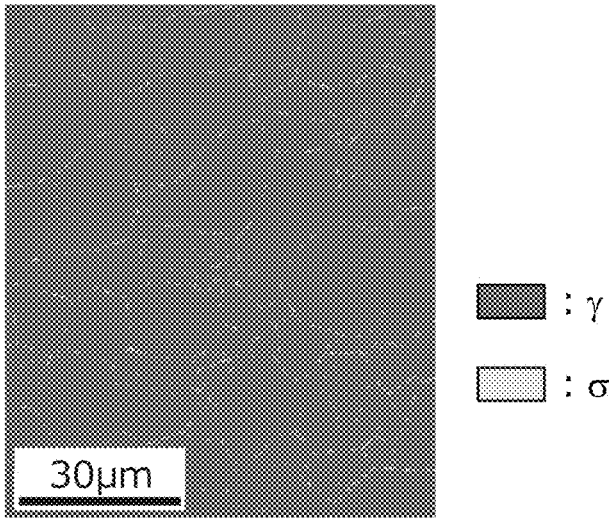
FIGS. 1A and 1B are electron micrographs showing the results of sigma phase measurement by EBSD performed on alloys for evaluation.

The present invention has been made in view of the above-described problems in the prior art. An object of the present invention is to provide Ni—Cr—Mo—N alloys having superior corrosion resistance at a temperature in which the sigma phase is precipitated, specifically, when exposed to a temperature of 700 to 1000° C.

In order to solve the above problems, the inventers have made extensive studies. As a result, the inventers have found alloys having superior corrosion resistance in which the area ratio the sigma phase is 1.0% or less after holding at a temperature of 950° C. for 30 min by adjusting alloy composition and satisfying Formulas (1) to (3).

That is, a highly corrosion-resistant Ni—Cr—Mo—N alloy having superior phase stability in the present invention comprises, in weight %, Ni: 22.0% or more, Cr: 22.0% or more, Mo: 5.0% or more, N: 0.180% or more, Si, Al, Mn, Fe as a remainder, and inevitable impurities, wherein the composition satisfies the following Formulas (1) to (3), and an area ratio of a sigma phase in a cross-sectional structure measured by EBSD after holding at 950° C. for 30 minutes is 1.0% or less.

$$Cr+3.3\times Mo+16\times N\geq 43.0 \quad (1)$$

$$7.3\times Mo—Ni\leq 21.0 \quad (2\text{-}1)$$

$$1.3\times Cr—Ni\leq 5.7 \quad (2\text{-}2)$$

$$1.6\times Si+0.99\times Mn+2.2\times Al\leq 0.95 \quad (3)$$

In the present invention, the composition preferably comprises C: 0.001 to 0.030%, Si: 0.02 to 0.30%, Mn: 0.02 to 0.40%, P: 0.005 to 0.050%, S: 0.0001 to 0.0030%, Ni: 22.0 to 38.0, Cr: 22.0 to 28.0, Mo: 5.0 to 8.0%, Cu: 0.02 to 0.50%, N: 0.180 to 0.250%, Al: 0.005 to 0.100%.

In the present invention, the composition preferably satisfies the following Formula (4), and further comprises B: 0.0005 to 0.0050%, and O: 35 ppm or less.

$$0.20\leq 1.6\times Si+0.99\times Mn+2.2\times Al\leq 0.95 \quad (4)$$

The present invention is a highly corrosion-resistant member, wherein the alloy is brazed using a Ni brazing material in an inert gas atmosphere at a temperature of 1000° C. or more.

The present invention is a sheathed heater comprising a cladding tube composed of the alloy according to and a junction formed with a Ni brazing material.

Effect of the Invention

According to the present invention, decrease in the corrosion resistance can be suppressed even if it is exposed to a temperature in which sigma phase is precipitated. Therefore, it is possible to provide a highly corrosion-resistant alloy that is suitable for manufacturing processes such as brazing, PWHT for weld portion, and annealing for removing residual strain after being clad with steel or the like.

EMBODIMENT FOR CARRYING OUT THE INVENTION

The inventers first examined a quantitative evaluation method for the sigma phase. The quantitative method for the sigma phase is generally carried out by a point-counting method such as ASTM E562. This is a method of evaluating the etched metal structure from the ratio of the lattice intersections of the reticle attached to the microscope overlapping the sigma phase. It is considered that evaluation results are affected by the results of etching for observation, and that there is a risk of including an error of about several percent with respect to the true amount of sigma phase precipitation. In addition, there are cases in which the small sigma phases do not overlap the lattice intersections, which is not preferable for evaluation of a small amount with an area ratio of 1% or less. Therefore, the inventors decided to evaluate the area ratio of the sigma phase by measuring using a field-emission scanning microscope and an electron back-scattered diffraction method (hereinafter referred to as the EBSD method), which are capable of high-definition measurement and can obtain high reliability in determining the crystal structure.

Figure 1B:
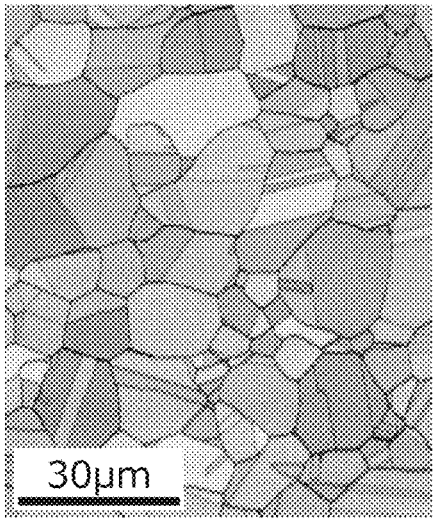

As an example of evaluation, the results of EBSD measurement on an Fe-0.01% C-23% Cr-35% Ni-7.48% Mo-0.22% N-0.04% Cu alloy are shown in FIG. 1. The sigma phase area was measured by the following method. A small piece cut perpendicular to the rolling direction from a 2 mm cold-rolled sheet which was subjected to heat treatment at 590° C. for 60 minutes was subjected to electropolishing with "Tenupol-5" manufactured by Struers Co., Ltd., and then, using an electron back-scattered diffraction device (manufactured by TSL Solutions Co., Ltd., "EBSD analysis software OIM Analysis 7.3") attached to a field emission scanning electron microscope (manufactured by JEOL Ltd., "JSM-7001F"), the sigma area ratio was obtained from the measuring result with a measurement area of 80 μm×240 μm and a step size of 0.2 μm. The size of the sigma phase was measured in two directions perpendicular to each other from the composition image of the scanning electron microscope, and the average value was taken as the particle size.

According to this method, a small sigma phase of 1 μm or less can be reliably captured, and accurate evaluation can be performed without problems such as scratches, adhesion of foreign matter, misidentification of non-metallic inclusions, and the like, which are problems in optical microscope observation. The smallest sigma phase confirmed by this measurement obtained from the composite image of the scanning electron microscope was about 0.1 μm×0.3 μm, and the average grain size in FIG. 1 was 1.4 μm. In addition, in the range of 850 to 1000° C., when it was investigated at which temperature and time the sigma phase precipitated the fastest, it was found to be 950° C. Considering the temperature rise and cooling of the brazing member, the holding time of about 950° C. was about 15 to 20 minutes, and the maximum was 30 minutes. Based on this, it was considered that if there was no precipitation even after holding at 950° C. for 30 minutes, there would be no deterioration in properties.

Experiment 1

In order to obtain an alloy with less sigma phase precipitation due to brazing, it was thought necessary that there be no sigma phase precipitation even when held at about 1050° C. for brazing, for example. Therefore, attention was focused on Ni, Cr, and Mo, which are the main elements, and the relationship between the structure and composition after holding at 1050° C. was investigated. In the experiment, using a high-frequency induction furnace, N was set to 0.225%, the content of elements was varied in the range of Ni: 18 to 36%, Cr: 20 to 29%, Mo: 5.5 to 8.0%, and consequently, 20 kg of alloys were dissolved. After that, they were subjected to hot forging, annealing, and cold rolling, and cold-rolled sheets with 2 mm thickness were obtained. The cold-rolled sheet was subjected to solution heat treatment at 1100° C. for 1 minute and cooled by forced air cooling. Furthermore, this cold-rolled annealed sheet was subjected to aging heat treatment at 1050° C. for 60 minutes, and the sigma phase area ratio was measured by EBSD. The measurement of the sigma phase area ratio by EBSD was performed by the method described above.

Figure 2A:
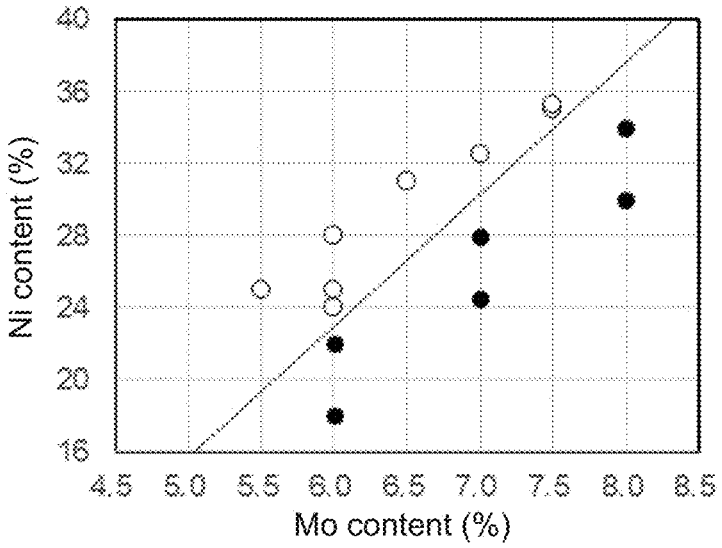
FIGS. 2A and 2B are graphs showing the effect of components on sigma phase precipitation; 2A shows the relationship between Ni content and Mo content, and 2B shows the relationship between Ni content and Cr content.
Figure 2B:
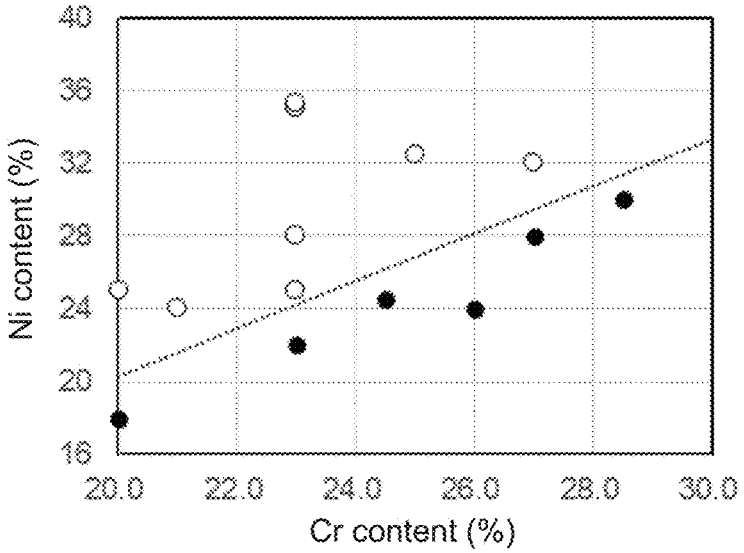

The experimental results are shown in the graph of FIG. 2, which shows the effect of the components on the sigma phase precipitation. (a) shows the relationship between the Ni content and the Mo content and (b) shows the relationship between the Ni content and the Cr content, when the sigma phase is 1.0% or less, the white circle is plotted, and when the sigma phase exceeds 1.0%, the black circle is plotted. From this figure, it was found that in order to suppress the sigma phase precipitation at 1050° C., it is necessary to add Ni and Mo, Ni and Cr in the proportions indicated by the dotted lines, that is, to satisfy the following formulas.

$$7.3\times Mo—Ni\leq 21.0$$

$$1.3\times Cr—Ni\leq 5.7$$

Experiment 2

In order to delay the sigma phase precipitation as much as possible and suppress deterioration of corrosion resistance, experiments were performed focusing on Si, Mn, and Al. Although it is known that Cr, Mo, Ni, and N have a large effect on the sigma phase precipitation, there is a limit to the control by these elements when ensuring corrosion resistance is premise. Therefore, attention was paid to the above three elements as other elements. In the experiment, a high-frequency induction furnace was used, and Fe-23.5% Cr-25.5% Ni-6.0% Mo-0.22% N-0.2% Cu was used as the basic component, and the contents of other elements were varied in the range of Si: 0.50% or less, Mn: 0.60% or less, and Al: 0.20% or less, and consequently, 20 kg of alloys were dissolved. The subsequent sample preparation method was the same as in Experiment 1, and the cold-rolled annealed sheet with 2 mm thickness was subjected to aging heat treatment at 950° C. for 30 minutes, and the sigma phase area ratio was measured by EBSD and the corrosion resistance was evaluated. The EBSD method is as described above, and the corrosion resistance is measured by performing an aqueous solution immersion test of ferric chloride and hydrochloric acid specified in ASTM G48 Method D, and the critical crevice corrosion temperature (CCT) was measured and evaluated. A test piece of 25 mm×50 mm was cut from a cold-rolled sheet which was subjected to aging heat treatment, the entire surface was wet-polished with SiC 120-grit abrasive paper, degreased with acetone, and then subjected to the test. 600 ml of the test solution was used for each sample, and the presence or absence of crevice corrosion with a depth of 25 μm or more was evaluated. The holding time was 100 hours which is longer than regulations to evaluate the effect of the smaller sigma phase. The clearance was formed using Teflon (registered trademark) multi-clevis, Ti bolts and nuts with a tightening torque of 0.28 N m. The reason why the crevice corrosion test was selected is that, in sheathed heaters, water scale adhered to the boundary between the base material and the Ni brazing material, and crevice corrosion occurred in this area.

Figure 3:
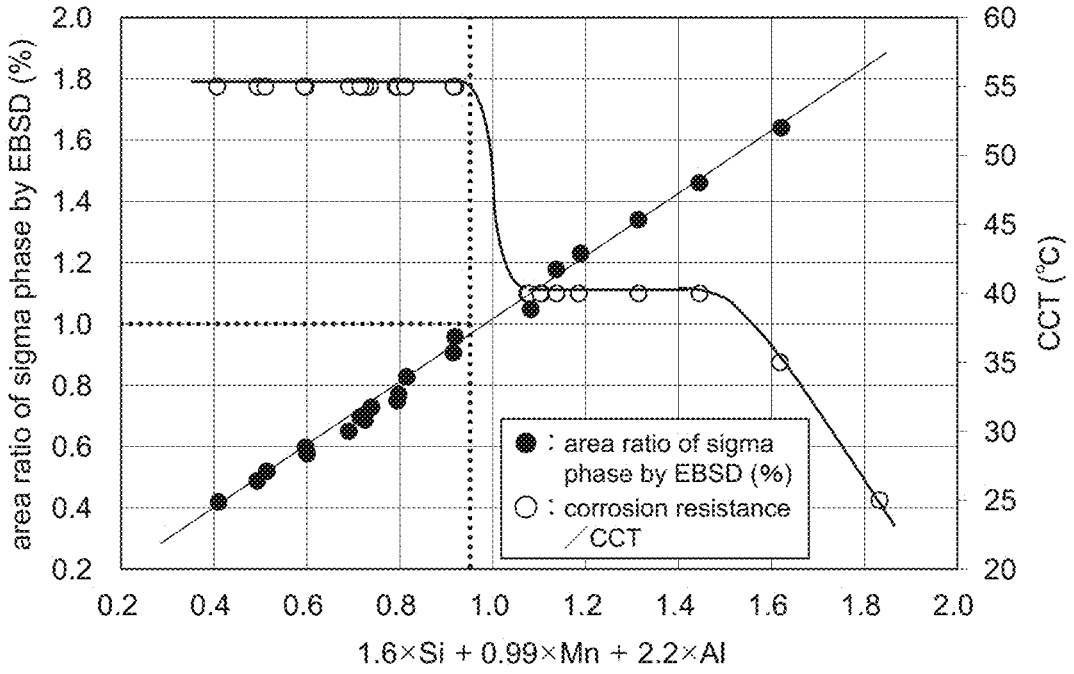
FIG. 3 is a graph showing the effect of Si content, Mn content, and Al content on the area ratio of sigma phase precipitation and corrosion resistance.

The experimental results are shown in the graph in FIG. 3, which shows the effects of the amounts of Si, Mn, and Al on the sigma phase precipitation area ratio and corrosion resistance. The horizontal axis represents the relationship between the sigma phase area ratio and the amounts of Si, Mn, and Al determined by regression analysis. The formation of the sigma phase can be suppressed by controlling the contents of these elements. It was found that the corrosion resistance at this time does not deteriorate when the amount of the sigma phase is small, but when it exceeds a certain amount, it significantly deteriorates and does not exhibit the initial characteristics. Its sigma phase area fraction is approximately 1.0%. It can be seen that to make the sigma phase content 1.0% or less, it is preferable to set the relational formula of Si, Mn, and Al to 0.95 or less. It was also confirmed that the average grain size of the sigma phase is 2.3 μm, and that the grain size as well as the grain number increase as the area ratio increases.

Figure 4:
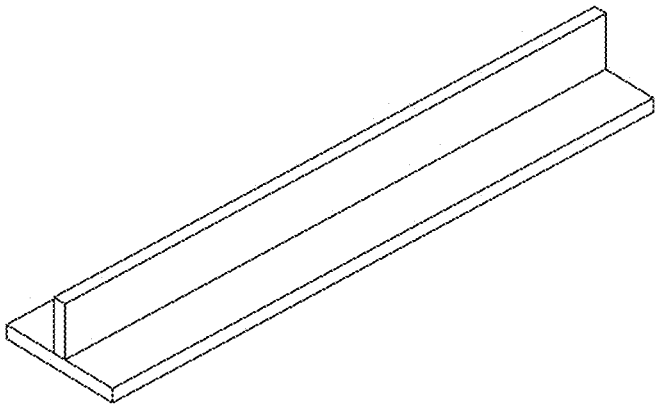
FIG. 4 is a schematic diagram of a test piece used for brazing evaluation.

In addition, Si, Mn, and Al are elements that easily oxidize, and they are oxidized by $O_2$, $H_2O$, CO, and the like, which are contained in minute amounts in the brazing atmosphere, and this may affect the wettability of the brazing material. Therefore, the effect of the wettability of the brazing material and the chemical component on the above alloy were investigated. The test piece was the above-mentioned plate with 2 mm thickness which was subjected to solution heat treatment, cut into (1) 10 mmw×100 mml, (2) 20 mmw×100 mml, and the entire surface was wet-polished with SiC 120-grit abrasive paper, and degreased with acetone. As shown FIG. 4, this was used as a T-shaped test piece in which (1) was vertically fixed in the center of the width of (2) by spot welding. When forming the test piece, the surface to be bonded were adjusted to have an arithmetic average roughness Ra of 1.6 or finer so that the degree of close contact was constant. About 1 g of brazing material was placed on one end of this test piece and brazed at 1020° C. in a hydrogen atmosphere, and the "wet length" over which the brazing material flowed and spread was evaluated. If it extended to the opposite side where the brazing material is placed, it was 100 mm. Nickel brazing material BNi-7(14Cr-10P—Ni) was used as a brazing material. The brazing process was carried out in a bridge-type brazing furnace with a total length of 12 m and a line speed of 1 m/min.

Figure 5:
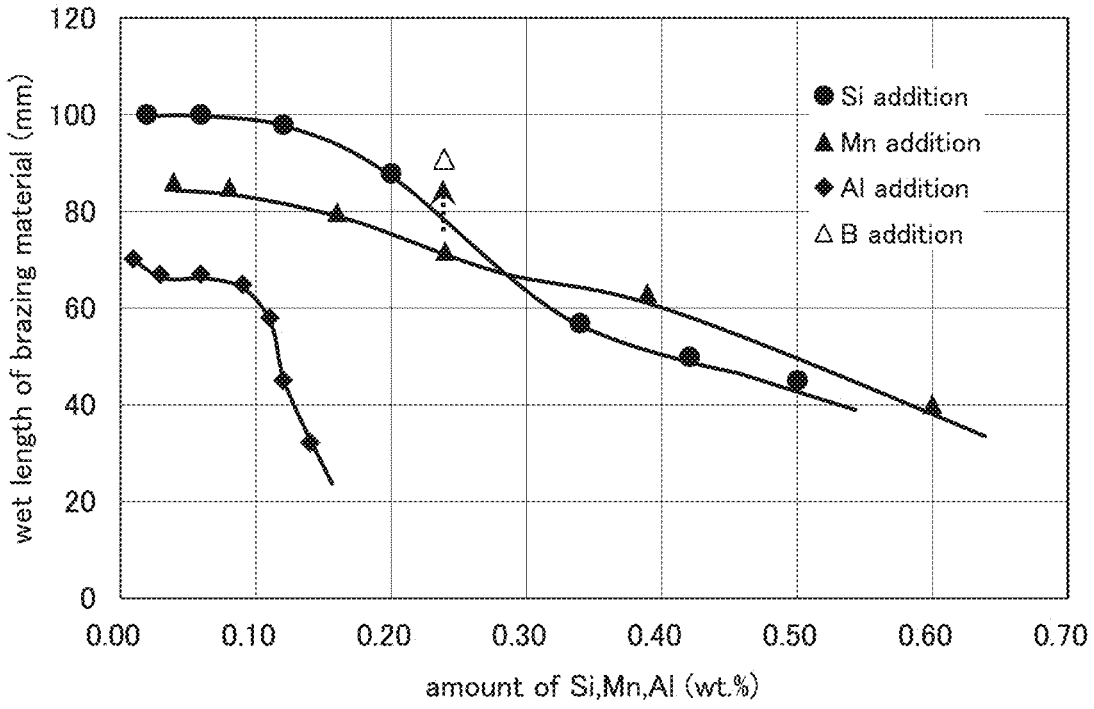
FIG. 5 is a graph showing the effect of Si content, Mn content, and Al content on wettability of Ni brazing material.

The evaluation results are shown in the graph of FIG. 5, which shows the effects of the amounts of Si, Mn, and Al on the wettability of Ni brazing material. As the content of these elements increase, the wetting length becomes shorter, impairing wettability. Therefore, it is desirable to extend the wetting length if possible, and if the content that spreads out to 60 mm, over half is set as the threshold, and the upper limits of Si, Mn, and Al were about 0.30%, 0.40%, and 0.10%, respectively. Also, when an alloy containing a small amount of B (Mn=0.24%, B=0.025%) was tested during the evaluation, it was found to have the effect of improving wettability. It is presumed that B sublimated from the alloy in the process of heating in an inert gas atmosphere for brazing and temporarily suppressed the oxidizing atmosphere. It was found that this is effective when it is desired to ensure more stable wettability.

Next, reasons for limiting the composition of each element in the present invention and the relational formula will be described. Hereinafter, % indicates weight %. In the present invention, as shown in claim 1, comprises Ni: 22.0% or more, Cr: 22.0% or more, Mo: 5.0% or more, N: 0.180% or more, Si, Al, Mn, Fe as a remainder, and inevitable impurities, wherein the composition satisfies the Formulas (1) to (3). In the following description, the preferred ranges recited in claim 2 and below are also explained.

C: 0.001 to 0.030%

C is an effective element for stabilizing the FCC phase (face-centered cubic structure) and suppresses precipitation of the sigma phase. Furthermore, it is an important element for ensuring strength. Therefore, addition of at least 0.001% is necessary. However, if it is contained excessively, precipitation of Cr carbides is facilitated, thereby deteriorating corrosion resistance. Therefore, the upper limit is set to 0.030%. The preferred lower limit of the content is 0.002%, a more preferred lower limit is 0.005%, the preferred upper limit is 0.025%, and a more preferred upper limit is 0.020%.

Si: 0.02 to 0.30%

Si is an important element having a deoxidizing action. Therefore, an addition of at least 0.02% is necessary. However, an excessive Si content promotes precipitation of a sigma phase, and is likely to form oxide scale, thereby deteriorating the wettability of the brazing material. Therefore, the upper limit is set to 0.30%. The preferred lower limit of the content is 0.07%, a more preferred lower limit is 0.09%, the preferred upper limit is 0.25%, and a more preferred upper limit is 0.23%.

Mn: 0.02 to 0.40%

Mn is an important element having a deoxidizing action, stabilizing the FCC phase, and increasing the solubility of N, so that it is an essential element for suppressing precipitation of carbonitrides and nitrides. Therefore, an addition of at least 0.02% is necessary. However, excessive addition promotes precipitation of the sigma phase, decreases corrosion resistance, and forms MnS, which becomes the starting point of pitting corrosion and deteriorates corrosion resistance. Furthermore, oxide scales are likely to form, thereby deteriorating the wettability of the brazing material. Therefore, the upper limit is set to 0.40%. The preferred lower limit of the content is 0.06%, the more preferred lower limit is 0.07%, the preferred upper limit is 0.35%, and the more preferred upper limit is 0.30%.

P: 0.005 to 0.050%

P is an element that is inevitably mixed in the alloy as an impurity, but in the present invention, it is an element that exists at the grain boundary and delays precipitation of the sigma phase. To obtain the effect, it is necessary to add more than 0.005%. However, if it is contained in an amount of 0.050% or more, corrosion resistance and hot workability are remarkably deteriorated. Therefore, the P content is set in a range of 0.005 to 0.050%. The preferred lower limit of the content is 0.010%, a more preferred lower limit is 0.012%, the preferred upper limit is 0.040%, and a more preferred upper limit is 0.035%.

S: 0.0001 to 0.0030%

S is an element that is inevitably mixed in the alloy as an impurity, and it deteriorates hot workability, forms sulfides, and acts as a starting point for pitting corrosion, thus adversely affecting the corrosion resistance. Therefore, the S content should be as low as possible. Therefore, the upper limit is set to 0.0030%. However, S is an element that improves weldability because it increases fluidity of the molten metal. From the point of obtaining good weldability, it is necessary to contain 0.0001% or more. The preferred lower limit of the content is 0.0002%, the more preferred lower limit is 0.0003%, the preferred upper limit is 0.0020%, and the more preferred upper limit is 0.0015%.

Ni: 22.0 to 38.0%

Ni is an element for stabilizing the FCC phase and suppressing precipitation of intermetallic compounds such as sigma phases and is an important element that improves pitting corrosion resistance and general corrosion resistance. Therefore, an addition of at least 22.0% is necessary. However, if the Ni content exceeds 38.0%, the hot deformation resistance increases and the cost increases. In addition, there is an optimum amount of Ni with respect to the amounts of Cr and Mo that promotes precipitation of the sigma phase. Therefore, the Ni content is set to a range of 22.0 to 38.0%. The preferred lower limit of the content is 23.0%, a more preferred lower limit is 24.0%, the preferred upper limit is 37.7%, and a more preferred upper limit is 37.5%.

Cr: 22.0 to 28.0%

Cr is an essential element for improving pitting corrosion resistance, crevice corrosion resistance, and intergranular corrosion resistance. It also has the effect of increasing solubility of nitrogen and suppressing the formation of nitrides. However, excessive Cr content promotes precipitation of sigma phases and deteriorates corrosion resistance. Therefore, the Cr content is set to a range of 22.0 to 28.0. The preferred lower limit of the content is 22.5%, a more preferred lower limit is 23.0%, the preferred upper limit is 27.5%, and a more preferred upper limit is 27.0%.

Mo: 5.0 to 8.0%

Mo, as well as Cr and N, and the like, is an element that improves pitting corrosion resistance and crevice corrosion resistance. However, if Mo is contained excessively, precipitation of the sigma phase is greatly accelerated and corrosion resistance is deteriorated. Therefore, the Mo content is set to the range of 5.0 to 8.0%. The preferred lower limit of the content is 5.1%, a more preferred lower limit is 5.2%, the preferred upper limit is 7.9%, and a more preferred upper limit is 7.8%.

Cu: 0.02 to 0.50%

Cu is an element that stabilizes the FCC phase and contributes to the improvement of acid resistance. To obtain the effect, it is necessary that it be contained at 0.02% or more. However, excessive addition increases costs and deteriorates hot workability, so that the upper limit is set to 0.50% or less. Therefore, the Cu content is set to the range of 0.02 to 0.50%. The preferred lower limit of the content is 0.04%, a more preferred lower limit is 0.05%, the preferred upper limit is 0.45%, and a more preferred upper limit is 0.40%.

N: 0.180 to 0.250%

N is an element that stabilizes the FCC phase and is effective in suppressing precipitation of the sigma phase. As well as Cr and Mo, it greatly improves pitting corrosion resistance and crevice corrosion resistance, and as well as C, it is an important element for ensuring strength. Therefore, addition of at least 0.18% is necessary. However, excessive addition promotes precipitation of carbonitrides and nitrides, resulting in decrease of corrosion resistance. Therefore, it must not exceed 0.250%. The preferred lower limit of the content is 0.185%, a more preferred lower limit is 0.190%, the preferred upper limit is 0.235%, and a more preferred upper limit is 0.230%.

Al: 0.005 to 0.100%

Al is an important element having a deoxidizing action. In addition, in the presence of $CaO—SiO_2—Al_2O_3—MgO$ type slag, it is an important element for promoting desulfurization by deoxidation and stabilizing the yield of B in refining. However, if it is contained excessively, it promotes precipitation of the sigma phase, tends to form oxide scale, and deteriorates wettability of a brazing material. Therefore, the Al content is set to the range of 0.005 to 0.100%. The preferred lower limit of the content is 0.015%, a more preferred lower limit is 0.025%, the preferred upper limit is 0.095%, and a more preferred upper limit is 0.090%.

$$Cr+3.3\times Mo+16\times N\geq 43.0 \quad (1)$$

To ensure corrosion resistance in an environment containing chlorides, it is necessary to add Cr, Mo, and N in certain amounts or more. Based on the effect of Cr, the effects of Mo and N are compared, and the coefficient regarding the effect of Cr is determined. For use in severe environments, it is required to be 43.0 or more. Preferably, it is 44.0 or more, and more preferably 50.0 or more.

$$7.3\times Mo—Ni\leq 21.0 \quad (2\text{-}1)$$

$$1.3\times Cr—Ni\leq 5.7 \quad (2\text{-}2)$$

When brazing is performed at about 1050° C., it is important that the sigma phase does not precipitate in this temperature range, that is, stability of the FCC phase is high.

The metal structure at 1050° C. is determined by the balance of Ni, Cr, and Mo, which are main components. Among these, Ni is an element that stabilizes the FCC phase, and the other two are elements that promote formation of a ferrite phase and a sigma phase. To suppress the forming of the sigma phase, it is necessary to ensure a balance and make an amount optimal. The former shows the relationship between Mo and Ni, and the latter shows the relationship between Cr and Ni. To effectively suppress forming of the sigma phase, the former must be 21.0 or less, preferably 20.0 or less, and more preferably 19.5 or less. Similarly, the latter must be 5.7 or less, preferably 5.6 or less, and more preferably 5.5 or less.

$$0.20 \leq 1.6 \times Si + 0.99 \times Mn + 2.2 \times Al \leq 0.95 \quad (3)$$

It is an important relational formula for controlling the sigma phase precipitation rate. Precipitation is suppressed by reducing all the elements Si, Mn, and Al. Based on the effect of Mn, the effects of Si and Al are compared, and the coefficient for the effect of Mn is determined. To perform brazing at a temperature of 1050° C. and to suppress precipitation of the sigma phase, it is necessary to make it at least 0.95 or less, preferably 0.93 or less, and more preferably 0.90 or less.

Si, Mn, and Al are elements having a deoxidizing effect, and if the content of these elements is reduced, the deoxidization is incomplete, the number of inclusions will increase, and as a result, the corrosion resistance will decrease. Moreover, hot workability is also deteriorated. Therefore, it is appropriate to ensure an addition amount that makes the relational formula 0.20 or more. The preferable lower limit of the relational formula is 0.30 or more, and more preferably 0.35 or more.

Area Ratio of Sigma Phase: 1.0% or Less

Although the sigma phase precipitates during heat treatment such as brazing and PWHT, and deteriorates corrosion resistance, accurate quantification of the sigma phase area ratio by EBSD and a corrosion test of this revealed that if the amount and the size are extremely small, deterioration of corrosion resistance is limited. The sigma phase area ratio must not exceed 1.0% for an acceptable level of deterioration in corrosion resistance. It is preferably 0.8% or less, and more preferably 0.7% or less. In addition, the large growth of the sigma phase indicates that the degree of Cr and Mo depleted layers formed in the vicinity thereof is worse. Therefore, it is preferable that the sigma phase be small to ensure corrosion resistance. In the present invention, the average size is 2.5 μm or less. It is preferably 2 μm or less, and more preferably 1.5 μm or less.

B: 0.0005 to 0.0050%

B is one of the important elements constituting the present invention and exists in grain boundaries. B has the effect of delaying the precipitation of the sigma phase, volatilizing prior to the melting of brazing material in the brazing process, and suppressing the oxidation of the alloy surface. B also improves hot workability and contributes to an improvement in yield. Therefore, it is necessary to add at least 0.0005%. However, an excessive B content causes deterioration of hot workability, cracking during welding, and the like, so that it is necessary to avoid excessive addition. Therefore, the upper limit is 0.0050%. The preferred lower limit of the content is 0.0007%, a more preferred lower limit is 0.0008%, the preferred upper limit is 0.0035%, and a more preferred upper limit is 0.0032%.

O: ≤35 ppm

O is an impurity element that is inevitably mixed into the alloy during melting, and is an element that deteriorates hot workability. Therefore, elements such as Si, Mn, and Al should be added to the molten metal to deoxidize and reduce the O content. In the present invention, the amount of these elements is restricted to suppress sigma phase precipitation. For this reason, it is necessary to monitor the elements and their addition amounts permitted in the present invention and combine them to sufficiently reduce the amount of oxygen. Therefore, the upper limit should be 35 ppm. The preferable upper limit is 33 ppm, and the more preferable upper limit is 30 ppm.

In the highly corrosion-resistant Ni—Cr—Mo—N alloy of the present invention, the remainder other than the above components consists of Fe and inevitable impurities. Here, the above-mentioned inevitable impurities are components that are inevitably mixed in due to various factors when stainless steels are produced industrially and are permissibly contained within a range that does not adversely affect the effect of the present invention.

Next, a method for producing a highly corrosion-resistant Ni—Cr—Mo—N alloy according to the present invention will be explained. Although the method for producing the alloy of the present invention is not particularly limited, it is preferably produced by the following method. First, raw materials such as Ni alloy scraps, iron scraps, stainless steel scraps, ferrochromium, ferronickel, pure nickel, and metallic chromium are melted in an electric furnace. After that, in an AOD furnace or a VOD furnace, oxygen gas and argon gas are blown for decarburization refining, and quicklime, fluorite, Al, Si, and the like, are added for desulfurization and deoxidation. The slag composition in this process is preferably adjusted to a $CaO—Al_2O_3—SiO_2—MgO—F$ type. At the same time, the slag preferably satisfies $CaO/Al_2O_3 \geq 2$ and $CaO/SiO_2 \geq 3$ to efficiently proceed with desulfurization. Moreover, the refractory material for the AOD furnace and the VOD furnace is desirably maguro or dolomite. After refining in the AOD furnace or the like, after adjusting the composition and temperature in the LF process, continuous casting is performed to produce a slab, followed by hot rolling, and cold rolling if necessary, thereby obtaining a thick plate, and a thin plate such as hot rolled alloy plate or cold rolled alloy plate.

EXAMPLE

The present invention will be further explained by way of examples. The present invention is not limited to these examples if the scope thereof is not exceeded.

First, pure iron, pure Ni, pure Cr, and pure Mo were melted in a 500 kg vacuum melting furnace and cast into a mold in vacuum to produce alloy ingots (Samples 1 to 4). Alloy plates having a thickness of 8 mm were obtained by hot forging the ingots. As other materials such as iron scraps, stainless steel scraps, and ferrochromium were melted in a 60-ton electric furnace (Samples 5 to 28). After that, in the AOD process, oxygen and argon were blown for decarburization refining. After that, quicklime, fluorite, Al, and Si were added to perform desulfurization and deoxidation. After that, ingot casting was performed by a continuous casting machine to obtain a slab. The chemical composition is shown in Table 1. The chemical components other than C, S, and N were analyzed by fluorescent X-ray analysis. N was analyzed by inert gas-impulse heat melting method, and C and S were analyzed by combustion in an oxygen stream-infrared absorption method. It should be noted that "---" in the table indicates that addition was not intentionally performed. Although B and O were not intentionally added, they were analyzed. The numerical values in the table are the results, and an analytical value of 0.0000 indicates that it was below the analytical limit.

After that, the slab was hot rolled according to a conventional method to obtain a hot-rolled alloy sheet having a thickness of 8.0 mm. Subsequently, the hot-rolled alloy sheet was subjected to solution heat treatment, followed by cold rolling, final annealing, and pickling to obtain a cold strip having a thickness of 2.0 mm. The solution heat treatment was carried out under the conditions of holding at 1150° C. for 1 minute and then cooling with water. Furthermore, the cold strip was subjected to aging heat treatment at 950° C. for a holding time of 30 minutes. Quantitative evaluation of the sigma phase was performed on the aging heat-treated material by the method described below.

Measurement of Sigma Phase Area Ratio

The sigma phase area ratio was measured for the plate subjected to the above heat treatment. The details are as follows and are the same as in Experiment 1.

- Test piece sampling direction: Sampling from the direction perpendicular to the rolling direction,
- Electropolishing device: "Tenupol-5" manufactured by Struers Co., Ltd
- EBSD measurement: Electron Back-scattered diffraction device (manufactured by TSL Solutions Co., Ltd., "EBSD analysis software OIM Analysis 7.0" attached to field emission scanning electron microscope (manufactured by JEOL Ltd., "JSM-7001F")
- Measurement area: 80 μm×240 μm
- Step size: 0.2 μm Grain Size of Sigma Phase The grain size of the sigma phase was measured by the same method as in Experiment 1, and the size was obtained from the composition image of a scanning electron microscope at a magnification of 5000 times.

Corrosion Resistance Evaluation Test

A ferric chloride solution immersion test specified in ASTM G48 (Method D) was carried out under the following conditions for a plate as it was solution heat treated and after it was subjected to aging heat treatment. The critical crevice corrosion initiation temperature (CCT) was measured for each plate, and the difference between two temperatures was used to compare the degree of deterioration in corrosion resistance. The evaluation was carried out such that when the aging heat treatment material has the same CCT as the solution heat treatment material, it was rated as A; when the decrease was 5° C., it was rated as B; when the decrease was 10° C., it was rated as C; and when the decrease was 15° C. or more, it was rated as D. In addition, in the test, when the CCT of the solution heat treatment material was 35° C. or less, since the corrosion resistance was low, it was rated as DD regardless of the test result of the aging heat treatment material.

- Test piece: width 25 mm×length 50 mm×thickness 2 mm
- Test solution: 6 mass % $FeCl_3$+1 mass % HCl aqueous solution
- Test liquid volume: 600 ml per test piece
- Surface polishing: full surface wet polishing with #120 SiC polishing paper
- Test time: 100 hours
- Gap forming jig: Teflon (registered trademark) multi-clevis, tightening torque 0.28 N·m Evaluation of Wettability of Brazing Material A T-shaped test piece was assembled by welding the plates after solution heat treatment and polishing, and evaluated by the "wet length" of the spread of the brazing material after brazing. Details are as follows. The brazing treatment was carried out in a bridge-type brazing furnace with a total length of 12 m in an atmosphere containing 100% hydrogen with a furnace soaking zone temperature of 1020° C. The line speed was 1 m/min. When the spread exceeded 80 mm, it was rated as A; when the spread was more than 70 mm and less than 80 mm, it was rated as B; and when the spread was more than 60 mm and less than 70 mm, it was rated as C. Those less than 60 mm were rated as D.

- Test piece: (1) width 10 mm×length 100 mm×thickness 2 mm, (2) width 20 mm×length 100 mm×thickness 2 mm
- Surface polishing: full surface wet polishing with #120 SiC polishing paper
- Assembly: fix (1) vertically in the center of width of (2) by spot welding
- Brazing material: Nickel brazing material BNi-7 (14Cr-10P—Ni)
- Amount of brazing material applied: 0.5 g at one end, applied in granules to the corner of test piece (1)

Evaluation of Non-Metallic Inclusions

A test piece was cut from a 2 mm cold-rolled sheet which was subjected to solution heat treatment, and the cleanliness was measured according to JIS 60555 (2003). The "total cleanliness" of B-based inclusions and C-based inclusion respectively represented by $Al_2O_3$ and $MnO{\cdot}SiO_2$ was evaluated. When the cleanliness was less than 0.05%, it was rated as A; when the cleanliness was more than 0.05% and less than 0.20%, it was rated as B; and when the cleanliness was more than 0.20% and less than 0.40%, it was rated as C. When the cleanliness was more than 0.40%, it was rated as D.

- Test piece: thickness of 2 mm, cut out from a cross section parallel to the elongation, total observation area of 300 $mm^2$.
- Finishing at the time of evaluation: mirror polishing with diamond paste having a particle size of 1 μm and a buff.
- Point counting method on optical microscope observation with 16 vertical and horizontal grid lines, observation magnification of 400 times Overall Evaluation Overall evaluation was carried out for the above three evaluations of corrosion resistance, wettability, and non-metallic inclusions. Overall evaluation was carried out by summing up the points in which A was 3 points, B was 2 points, C was 1 point, and D was 0 points. Since it is most important for the alloys of the present invention to be superior in corrosion resistance, those with an evaluation D were judged to be inferior regardless of the other evaluation results. In addition, since this evaluation should be made with more weight than other items, the overall evaluation was performed with the score of corrosion resistance doubled. When there is no D in the corrosion resistance evaluation, and it exceeded 3 points and was 4 points or less, it was rated as acceptable; when it exceeded 4 points and was 7 points or less, it was rated as good; when it exceeded 7 points and was 9 points or less, it was rated as very good; and when it exceeded 9 points, it was rated as excellent.

TABLE 1

| | No. | C | Si | Mn | P | S | Ni | Cr | Mo | Cu | N | Al | B | O | Formula 1 |
|---|---|---|---|---|---|---|---|---|---|---|---|---|---|---|---|
| Example | 1 | — | 0.19 | 0.23 | — | — | 25.4 | 23.3 | 5.6 | — | 0.209 | 0.050 | 0.0001 | 27 | 45.12 |
| | 2 | — | 0.21 | 0.21 | — | — | 35.5 | 24.1 | 7.4 | — | 0.224 | 0.040 | 0.0002 | 27 | 52.10 |
| | 3 | — | 0.24 | 0.31 | — | — | 32.2 | 22.9 | 6.4 | — | 0.216 | 0.030 | 0.0000 | 28 | 47.48 |
| | 4 | — | 0.05 | 0.09 | — | — | 30.9 | 23.5 | 6.8 | — | 0.225 | 0.006 | 0.0000 | 49 | 49.54 |
| | 5 | 0.005 | 0.33 | 0.18 | 0.013 | 0.0006 | 27.8 | 25.5 | 6.2 | 0.42 | 0.196 | 0.020 | 0.0001 | 26 | 49.10 |
| | 6 | 0.025 | 0.03 | 0.43 | 0.042 | 0.0021 | 37.8 | 25.8 | 7.9 | 0.49 | 0.182 | 0.010 | 0.0001 | 33 | 54.78 |
| | 7 | 0.028 | 0.10 | 0.13 | 0.033 | 0.0015 | 24.5 | 23.1 | 5.8 | 0.08 | 0.201 | 0.121 | 0.0000 | 6 | 45.46 |
| | 8 | 0.023 | 0.03 | 0.10 | 0.015 | 0.0016 | 35.5 | 22.9 | 7.2 | 0.08 | 0.231 | 0.009 | 0.0000 | 52 | 50.36 |
| | 9 | 0.006 | 0.23 | 0.07 | 0 034 | 0.0003 | 24.7 | 23.1 | 6.2 | 0.06 | 0.192 | 0.013 | 0.0004 | 45 | 46.63 |
| | 10 | 0.007 | 0.21 | 0.28 | 0.021 | 0.0004 | 25.9 | 24.1 | 6.5 | 0.12 | 0.210 | 0.032 | 0.0001 | 31 | 48.91 |
| | 11 | 0.016 | 0.12 | 0.13 | 0.016 | 0.0017 | 27.5 | 25.5 | 6.4 | 0.23 | 0.226 | 0.045 | 0.0000 | 27 | 50.24 |
| | 12 | 0.009 | 0.09 | 0.08 | 0.018 | 0.0019 | 24.8 | 23.0 | 6.0 | 0.35 | 0.203 | 0.010 | 0.0001 | 46 | 46.05 |
| | 13 | 0.024 | 0.23 | 0.32 | 0.014 | 0.0024 | 31.1 | 22.2 | 7.0 | 0.09 | 0.235 | 0.072 | 0.0003 | 18 | 49.06 |
| | 14 | 0.002 | 0.24 | 0.35 | 0.012 | 0.0002 | 33.4 | 27.4 | 7.4 | 0.04 | 0.186 | 0.078 | 0.0003 | 17 | 54.80 |
| | 15 | 0.001 | 0.26 | 0.29 | 0.005 | 0.0001 | 34.6 | 22.2 | 6.9 | 0.03 | 0.248 | 0.006 | 0.0000 | 42 | 48.94 |
| | 16 | 0.026 | 0.27 | 0.02 | 0.042 | 0.0023 | 35.6 | 22 4 | 7.8 | 0.49 | 0.181 | 0.097 | 0.0003 | 25 | 51.04 |
| | 17 | 0.002 | 0.22 | 0.25 | 0.034 | 0.0022 | 36.1 | 24.5 | 7.5 | 0.35 | 0.206 | 0.068 | 0.0002 | 35 | 52.55 |
| | 18 | 0.029 | 0.29 | 0.39 | 0.049 | 0.0030 | 37.8 | 27.8 | 7.3 | 0.45 | 0.239 | 0.045 | 0.0049 | 37 | 55.71 |
| | 19 | 0.021 | 0.25 | 0.31 | 0.038 | 0.0022 | 33.3 | 22.6 | 7.5 | 0.43 | 0.235 | 0.009 | 0.0007 | 31 | 51.11 |
| | 20 | 0.018 | 0.17 | 0.19 | 0.025 | 0.0010 | 26.6 | 24.7 | 5.9 | 0.18 | 0.199 | 0.067 | 0.0015 | 18 | 47.35 |
| | 21 | 0.011 | 0.19 | 0.24 | 0.027 | 0.0008 | 27.4 | 24 5 | 5.3 | 0.29 | 0.184 | 0.055 | 0.0031 | 21 | 44.93 |
| | 22 | 0.013 | 0.15 | 0.15 | 0.023 | 0.0013 | 23.5 | 22.4 | 5.3 | 0.31 | 0.195 | 0.024 | 0.0020 | 9 | 43.01 |
| | 23 | 0.021 | 0.15 | 0.15 | 0.009 | 0.0009 | 23.7 | 22.5 | 5.1 | 0.15 | 0.242 | 0.033 | 0.0005 | 25 | 43.20 |
| | 24 | 0.014 | 0.21 | 0.23 | 0.022 | 0.0012 | 34.0 | 26.4 | 5.9 | 0.20 | 0.212 | 0.022 | 0.0037 | 5 | 49.26 |
| Comparative Example | 25 | 0.012 | 0.25 | 0.27 | 0.021 | 0.0005 | 28.1 | 22.2 | 5.2 | 0.06 | 0.181 | 0.023 | 0.0001 | 30 | (42.26) |
| | 26 | 0.015 | 0.25 | 0.38 | 0.032 | 0.0001 | 35.1 | 27.5 | 7.2 | 0.13 | 0.233 | 0.088 | 0.0000 | 5 | 54.99 |
| | 27 | 0.021 | 0.16 | 0.19 | 0.027 | 0.0002 | 35.1 | 24.1 | 7.8 | 0.31 | 0.214 | 0.005 | 0.0000 | 42 | 53.26 |
| | 28 | 0.007 | 0.28 | 0.33 | 0.009 | 0.0011 | 22.2 | 22.7 | 5.3 | 0.26 | 0.242 | 0.012 | 0.0000 | 33 | 44.06 |
| | 29 | 0.0017 | 0.09 | 0.03 | 0.029 | 0.0013 | 22.2 | (20.4) | 5.92 | 0.28 | 0.245 | 0.010 | 0.0000 | 52 | 43.86 |

| | No. | Formula 2-1 | Formula 2-2 | Formula 3 | Area ratio of sigma phase | Grain size | Corrosion resistance | | Wetta-bility | | Inclu-sion | | Total evaluation | |
|---|---|---|---|---|---|---|---|---|---|---|---|---|---|---|
| Example | 1 | 14.9 | 4.89 | 0.64 | 0.8 | 2.8 | BB | 4 | B | 2 | B | 2 | Very good | 8 |
| | 2 | 17.8 | −4.17 | 0.63 | 0.8 | 1.9 | AA | 5 | B | 2 | B | 2 | Excellent | 10 |
| | 3 | 13.9 | −2.43 | 0.76 | 0.6 | 2.7 | BB | 4 | B | 2 | B | 2 | Very good | 8 |
| | 4 | 18.1 | −0.35 | 0.18 | 0.2 | 1.8 | AA | 6 | B | 2 | D | 0 | Very good | 8 |
| | 5 | 16.8 | 5.35 | 0.75 | 0.8 | 2.4 | CC | 2 | D | 0 | C | 1 | Acceptable | 3 |
| | 6 | 19.1 | −4.26 | 0.50 | 0.6 | 2.5 | CC | 2 | D | 0 | C | 1 | Acceptable | 3 |
| | 7 | 17.3 | 5.53 | 0.55 | 0.8 | 2.0 | CC | 2 | D | 0 | C | 1 | Acceptable | 3 |
| | 8 | 16.3 | −5.73 | 0.17 | 0.2 | 1.8 | BB | 4 | B | 2 | D | 0 | Good | 6 |
| | 9 | 19.9 | 5.33 | 0.47 | 0.2 | 1.5 | BB | 4 | B | 2 | C | 1 | Very good | 7 |
| | 10 | 20.9 | 5.43 | 0.68 | 0.8 | 1.8 | CC | 2 | B | 2 | C | 1 | Good | 5 |
| | 11 | 18.6 | 5.65 | 0.42 | 0.4 | 2.0 | CC | 2 | B | 2 | C | 1 | Good | 5 |
| | 12 | 18.4 | 5.10 | 0.25 | 0.2 | 1.6 | BB | 4 | B | 2 | C | 1 | Good | 7 |
| | 13 | 19.3 | −2.24 | 0.84 | 0.8 | 1.7 | CC | 2 | B | 2 | C | 1 | Good | 5 |
| | 14 | 19.9 | 2.22 | 0.90 | 1.0 | 2.5 | CC | 2 | B | 2 | C | 1 | Good | 5 |
| | 15 | 15.1 | −5.74 | 0.72 | 0.8 | 1.5 | BB | 4 | B | 2 | C | 1 | Very good | 7 |
| | 16 | 20.6 | −6.48 | 0.67 | 0.6 | 1.9 | BB | 4 | B | 2 | C | 1 | Very good | 7 |
| | 17 | 17.9 | −4.25 | 0.75 | 0.8 | 2.3 | CC | 2 | A | 3 | C | 1 | Good | 6 |
| | 18 | 14.8 | −1.66 | 0.95 | 0.8 | 2.4 | CC | 2 | A | 3 | B | 2 | Very good | 7 |
| | 19 | 20.7 | −3.92 | 0.73 | 0.8 | 2.1 | CC | 2 | A | 3 | B | 2 | Very good | 7 |
| | 20 | 15.9 | 5.51 | 0.61 | 0.4 | 2.0 | AA | 6 | A | 3 | B | 2 | Excellent | 11 |
| | 21 | 10.8 | 4.45 | 0.66 | 0.4 | 1.2 | AA | 6 | A | 3 | B | 2 | Excellent | 11 |
| | 22 | 14.7 | 5.62 | 0.44 | 0.2 | 0.6 | AA | 6 | A | 3 | B | 2 | Excellent | 11 |
| | 23 | 13.0 | 5.55 | 0.46 | 0.4 | 0.8 | AA | 6 | A | 3 | B | 2 | Excellent | 11 |
| | 24 | 8.5 | 0.32 | 0.61 | 0.2 | 2.2 | AA | 6 | A | 3 | B | 2 | Excellent | 11 |
| Comparative Example | 25 | 9.3 | 0.76 | 0.72 | 0.4 | 0.5 | DD | 0 | B | 2 | C | 1 | Bad | — |
| | 26 | 16.7 | 0.65 | (0.97) | 1.6 | 2.9 | DD | 0 | C | 1 | C | 1 | Bad | — |
| | 27 | (21.1) | −3.77 | 0.46 | 1.6 | 2.9 | DD | 0 | B | 2 | B | 2 | Bad | — |
| | 28 | 16.0 | (7.31) | 0.80 | 2.2 | 3.1 | DD | 0 | B | 2 | C | 1 | Bad | — |
| | 29 | 20.4 | 4.32 | 0.20 | 0.0 | 0 | DD | 0 | C | 1 | C | 1 | Bad | 2 |

Examples 1 to 7 satisfy the component and Formulas (1) to (3), and sigma phase area ratio defined in claim 1 of the present invention, so that the overall evaluations were acceptable to excellent. Examples 8 to 18 are also within the range of claim 2, so that the overall evaluations were good to excellent. Examples 19 to 24 satisfy the component range of B and O and Formula (4), the overall evaluations were very good and excellent. The reason Example 19 was slightly inferior in corrosion resistance is that the O content was 31 ppm, which was relatively high, although it was within the range.

In contrast, Comparative Example 25 did not satisfy Formula (1), Comparative Example 26 did not satisfy Formula (3), Comparative Example 27 did not satisfy Formula (2-1), Comparative Example 28 did not satisfy Formula (2-2), and so they were inferior in corrosion resistance.

Although Comparative Example 29 satisfied Formulas (1), (2-1), (2-2), and (3), since Cr was out of the range and the amount of Mn was small, Cr nitrides were precipitated. As a result, it was inferior in corrosion resistance and the wettability was not good, probably because the precipitated nitrides hindered wettability.

The invention claimed is:

1. A Ni—Cr Mo—N alloy consisting of, in weight %,
C: 0.001 to 0.030%,
Si: 0.02 to 0.30%,
Mn: 0.02 to 0.40%,
P: 0.005 to 0.050%,
S: 0.0001 to 0.0030%,
Ni: 22.0 to 38.0,
Cr: 22.0 to 28.0,
Mo: 5.0 to 8.0%,
Cu: 0.02 to 0.45%,
N: 0.180 to 0.250%,
Al: 0.005 to 0.100%,
Fe as a remainder, and inevitable impurities,
wherein the composition satisfies the following Formulas (1) to (3);

$$Cr+3.3\times Mo+16\times N\geq 43.0 \quad (1)$$

$$7.3\times Mo—Ni\leq 21.0 \quad (2\text{-}1)$$

$$1.3\times Cr—Ni\leq 5.7 \quad (2\text{-}2)$$

$$1.6\times Si+0.99\times Mn+2.2\times Al\leq 0.95 \quad (3), \text{ and}$$

an area ratio of a sigma phase in a cross-sectional structure measured by EBSD after holding at 950° C. for 30 minutes is 1.0% or less.

2. A sheathed heater comprising a cladding tube composed of the alloy according to claim 1 and a junction formed with a Ni brazing material.

3. A Ni—Cr Mo—N alloy consisting of, in weight %,
C: 0.001 to 0.030%,
Si: 0.02 to 0.30%,
Mn: 0.02 to 0.40%,
P: 0.005 to 0.050%,
S: 0.0001 to 0.0030%,
Ni: 22.0 to 38.0,
Cr: 22.0 to 28.0,
Mo: 5.0 to 8.0%,
Cu: 0.02 to 0.45%,
N: 0.180 to 0.250%,
Al: 0.005 to 0.100%,
B: 0.0005 to 0.0050%,
O: 35 ppm or less,
Fe as a remainder, and inevitable impurities,
wherein the composition satisfies the following Formulas (1) to (4):

$$Cr+3.3\times Mo+16\times N\geq 43.0 \quad (1)$$

$$7.3\times Mo—Ni\leq 21.0 \quad (2\text{-}1)$$

$$1.3\times Cr—Ni\leq 5.7 \quad (2\text{-}2)$$

$$1.6\times Si+0.99\times Mn+2.2\times Al\leq 0.95 \quad (3)$$

$$0.20\leq 1.6\times Si+0.99\times Mn+2.2\times Al\leq 0.95 \quad (4), \text{ and}$$

an area ratio of a sigma phase in a cross-sectional structure measured by EBSD after holding at 950° C. for 30 minutes is 1.0% or less.

4. A sheathed heater comprising a cladding tube composed of the alloy according to claim 3 and a junction formed with a Ni brazing material.

* * * * *